US009145664B2

(12) United States Patent
Yuan et al.

(10) Patent No.: US 9,145,664 B2
(45) Date of Patent: Sep. 29, 2015

(54) WEIGHT ASSEMBLY FOR A FAUCET

(71) Applicant: Globe Union Industrial Corp., Tanzi Dist., Taichung (TW)

(72) Inventors: Chuahua Yuan, Taichung (TW); Yiping Lin, Taichung (TW); Yongiun Wu, Shen Zen (CN); Cijun Li, Shen Zen (CN)

(73) Assignee: GLOBE UNION INDUSTRIAL CORP., Taichung (TW)

( * ) Notice: Subject to any disclaimer, the term of this patent is extended or adjusted under 35 U.S.C. 154(b) by 0 days.

(21) Appl. No.: 14/514,265

(22) Filed: Oct. 14, 2014

(65) Prior Publication Data

US 2015/0113767 A1 Apr. 30, 2015

(30) Foreign Application Priority Data

Oct. 25, 2013 (CN) ..... 2013 2 0664226

(51) Int. Cl.
*E03C 1/04* (2006.01)

(52) U.S. Cl.
CPC ..... *E03C 1/04* (2013.01); *E03C 2001/0415* (2013.01); *Y10T 16/82* (2015.01)

(58) Field of Classification Search
CPC ... Y10T 16/82; E03C 1/04; E03C 2001/0415; E05Y 2201/416; B05B 15/06
USPC ..... 16/400; 138/103; 137/801; 239/588; 4/678
See application file for complete search history.

(56) References Cited

U.S. PATENT DOCUMENTS

| | | | | |
|---|---|---|---|---|
| 5,771,934 | A * | 6/1998 | Warshawsky | 137/801 |
| 5,960,832 | A * | 10/1999 | Warshawsky | 137/801 |
| 6,250,338 | B1 * | 6/2001 | Dempsey | 138/103 |
| 6,460,570 | B1 * | 10/2002 | Jones et al. | 137/801 |
| 7,143,780 | B1 * | 12/2006 | Pitts | 137/382 |
| 2004/0216789 | A1 * | 11/2004 | Benstead et al. | 137/801 |
| 2012/0042972 | A1 * | 2/2012 | Liu et al. | 137/801 |
| 2015/0113767 | A1 * | 4/2015 | Yuan et al. | 16/400 |

* cited by examiner

*Primary Examiner* — William Miller

(57) ABSTRACT

A weight assembly for a faucet contains: a counterweight including a channel, the channel having an elongated first opening and a longitudinal height, and the longitudinal height being larger than a diameter of the hose; the counterweight also including a non-circular orifice, a first accommodating cavity, and a second accommodating cavity; a retainer inserted into the second accommodating cavity, the non-circular orifice, and the first accommodating cavity and including a notch for defining a second opening facing to the first opening; the notch having an arc-shaped contacting fringe; a longitudinal height of the second opening along the Z-axis direction being larger than the diameter of the hose; a pressing member mounted on a top end of the retainer; a resilient element defined between the first accommodating cavity of the counterweight and the pressing member. Thereby, the counterweight is removed and replaced easily by pressing and releasing the pressing member.

10 Claims, 10 Drawing Sheets

WEIGHT ASSEMBLY FOR A FAUCET

FIELD OF THE INVENTION

The present invention relates to a weight assembly which is fixed on a hose of a faucet, and the hose is connected with a spray head so that water sprays out of the spray head via the hose.

BACKGROUND OF THE INVENTION

A conventional spray hose assembly includes a hose and a spray head, and one end of the hose is connected to a water supply source, and another end thereof is coupled to the spray head. In a normal state, the hose is fixed under a tank, and the spray head is positioned in a receiving seat of the tank so that when a user pulls the spray head, the hose extends outward from an opening of the receiving seat. Moreover, a weight assembly is installed on the hose so that the spray head returns back to the receiving seat when in no use by using the weight assembly's weight.

A conventional weight assembly is integrally made and formed in an oval shape, includes a hole to insert and retain a hose, however when the weight assembly is assembled, it has to be fitted from one end of the hose and then moved toward a suitable position along the hose, thus having an inconvenient assembly. For example, when two ends of the hose are connected, the weight assembly is not easy to be removed, and because a size of the hole is fixed, as the hole is in a small size, the weight assembly cannot be moved along the hose easily. Even though the weight assembly is capable of being moved along the hose, the hose is deformable and broken easily. While the hole is in a large size, the weight assembly cannot be fixed on the hose securely.

Another conventional weight assembly includes two part pieces, each including a groove extending thereon vertically, and the part pieces are connected together by ways of a retaining member with screws, such as a screw bolt, so as to retain a hose between the grooves. Nevertheless, the part pieces have to be aligned with the hose, and then one of the part pieces is inserted by the retaining member to be further screwed in a screwing bore of another part piece, thus connecting the part pieces together. But after the part pieces are connected together, they cannot be fixed on the hose directly. In other words, the retaining member has to be removed from the part pieces first so that the part pieces are disassembled from each other, and then the grooves of the part pieces are used to receive the hose so as to have further installing process. While the weight assembly is removed from the hose, the retaining member is removed so that the part pieces are disassembled from each other and removed from the hose further, having time consuming installation.

U.S. Pat. No. 6,460,570 discloses a weight assembly including a body having a plane extending vertically, and including an open groove, a depth of which is more than a half of a diameter of a hose so as to receive the hose, and including a retaining member with inner screws to pass through the groove and to screw with outer screws of the plane of the body so that the weight assembly is fixed on the hose tightly.

However, before fixing or removing the retaining member, it has to be removed from the body or the hose. For example, after the body is fixed on the hose, it has to be screwed with the retaining member further, thus removing and screwing the retaining member repeatedly to cause an inconvenient assembly.

To overcome above-mentioned problem, a weight assembly is disclosed in US Publication No. 2012/0042972 A1 and contains: a counterweight, and the counterweight has a channel horizontally extending along an X axis to define a first opening for inserting a hose into the channel from the first opening, the counterweight also has an orifice defined on a central position thereof and passing through the channel along a Z axis, a first accommodating cavity and a second accommodating cavity arranged on two ends of the orifice; a retainer accommodated in the orifice, the first accommodating cavity and the second accommodating, and the retainer including a notch defined on a middle section thereof to define a second opening for inserting the hose into the notch; a fixing element screwed with the first accommodating cavity and a top end of the retainer, such that the retainer is forced to move upwardly, and the hose is retained between the notch and the top end of the channel.

Nevertheless, the weight assembly is fixed and removed by rotating the fixing element tightly or loosely, thus fixing the weight assembly troublesomely. Furthermore, the fixing element will be loose after a period of using time, and the hose will deform easily as screwing the fixing element extra-tightly.

The present invention has arisen to mitigate and/or obviate the afore-described disadvantages.

SUMMARY OF THE INVENTION

One aspect of the present invention is to provide a weight assembly for a faucet which is capable of overcoming the shortcomings of the conventional weight assembly for the faucet.

To obtain the above, a weight assembly for a faucet provided by the present invention contains:

a counterweight including a channel defined therein in an X-axis direction, the channel having an elongated first opening defined therein and a longitudinal height defined in a Z-axis direction, and the longitudinal height being larger than a diameter of the hose, such that the hose is placed into the channel, a depth of the channel in a Y-axis direction being larger than the diameter of the hose, and hose being accommodated in the channel completely; the counterweight also including an orifice formed on a central position thereof and along the Z-axis direction, the orifice passing through and communicating with a middle section of the channel; the counterweight further including a first accommodating cavity defined on a top end thereof in the Z-axis direction and a second accommodating cavity arranged on a bottom end thereof in the Z-axis direction, and the orifice passing through the first accommodating cavity and the second accommodating cavity;

a retainer inserted into the second accommodating cavity, the orifice, and the first accommodating cavity and including a notch arranged on a middle section thereof to define a second opening facing to the first opening; the notch having an arc-shaped contacting fringe formed on a bottom end thereof and corresponding to a peripheral wall of the hose; a longitudinal height of the second opening along the Z-axis direction being larger than the diameter of the hose;

a pressing member mounted on a top end of the retainer;

a resilient element defined between the first accommodating cavity of the counterweight and the pressing member to push the pressing member, and then the pressing member driving the retainer to move upwardly along the Z-axis direction, such that the hose in the notch of the retainer is retained between the contacting fringe and the channel.

Thereby, the weight assembly of the present invention has following advantages:

1. The hose is fixed easily by pressing and releasing the pressing member.

2. The hose is retained at a stable clamping force by using the resilient element to avoid deformation. In other words, the elasticity of the resilient element is controlled easily so that the hose is retained at the stable clamping force.

3. The counterweight is packaged firstly and then is unpacked to connect with the hose quickly.

4. The counterweight is removed and replaced easily by pressing and releasing the pressing member.

5. The pressing member is pressed completely so that the hose is inserted into the notch of the retainer exactly and quickly.

6. The hose is retained between the arcuate fence of the channel and the contacting fringe and does not deform.

DETAILED DESCRIPTION OF THE PREFERRED EMBODIMENTS

Figure 1:
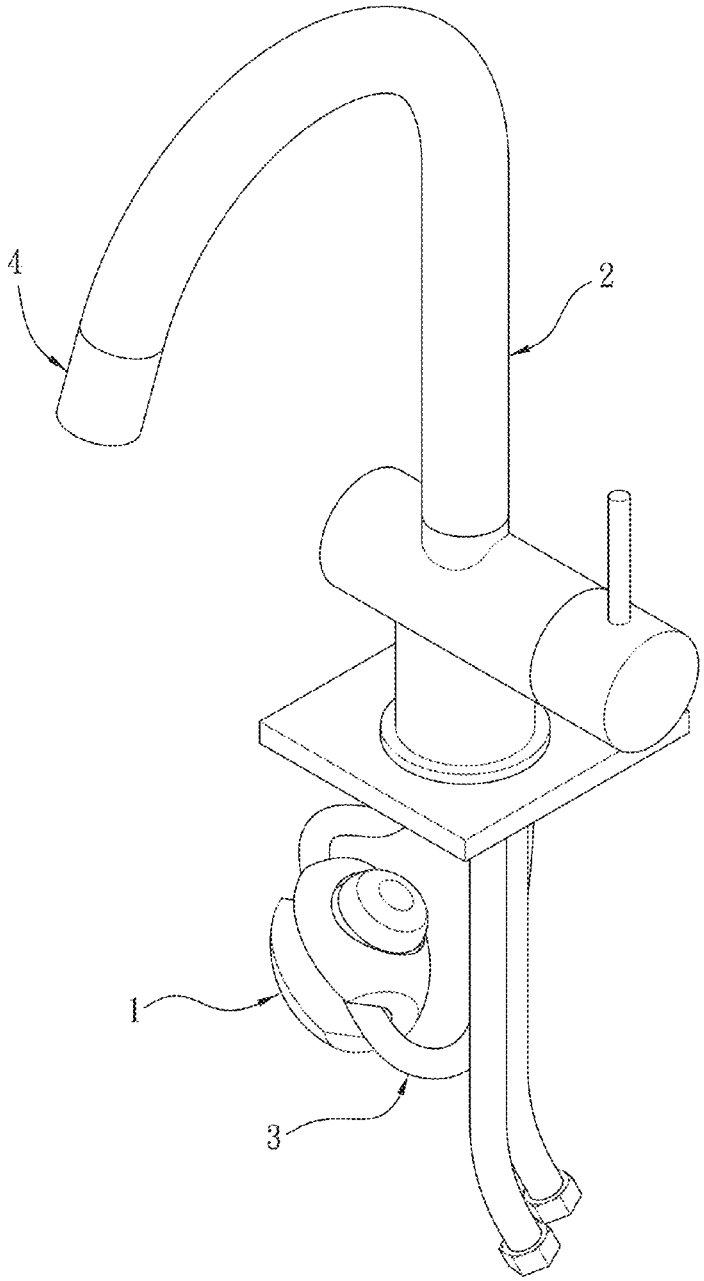
FIG. 1 is a perspective view showing a weight assembly for a faucet being fixed on a hose of a faucet according to a preferred embodiment of the present invention.

With reference to FIG. 1, a weight assembly 1 for a faucet according to a preferred embodiment of the present invention is fixed on a hose 3 of a faucet 2, and the hose 3 is connected with a spray head 4 so that water sprays out of the spray head 4 via the hose 30.

Referring to FIGS. 2-7, the weight assembly 1 includes a counterweight 10, a retainer 20, a pressing member 30, and a resilient element 40.

Figure 2:
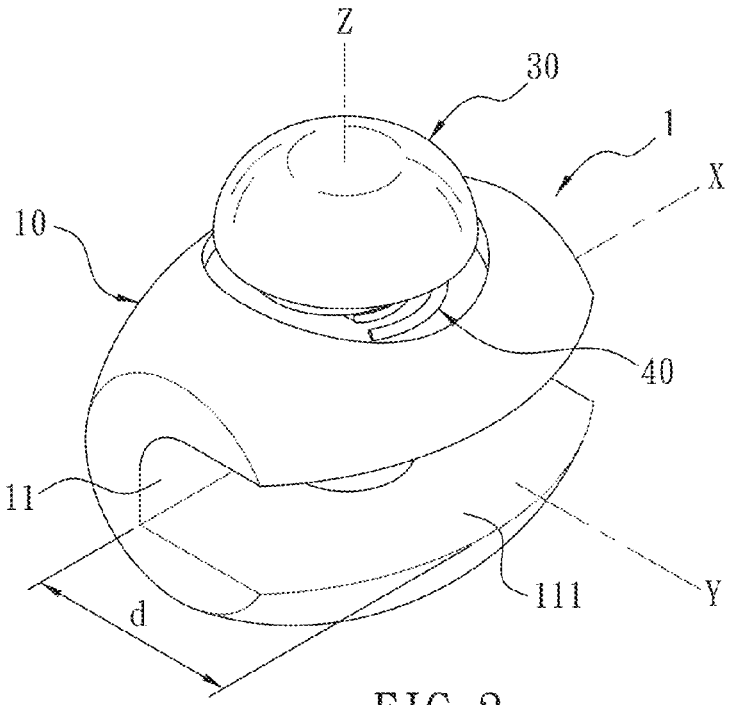
FIG. 2 is a perspective view showing the assembly of the weight assembly for the faucet according to the preferred embodiment of the present invention.
Figure 3:
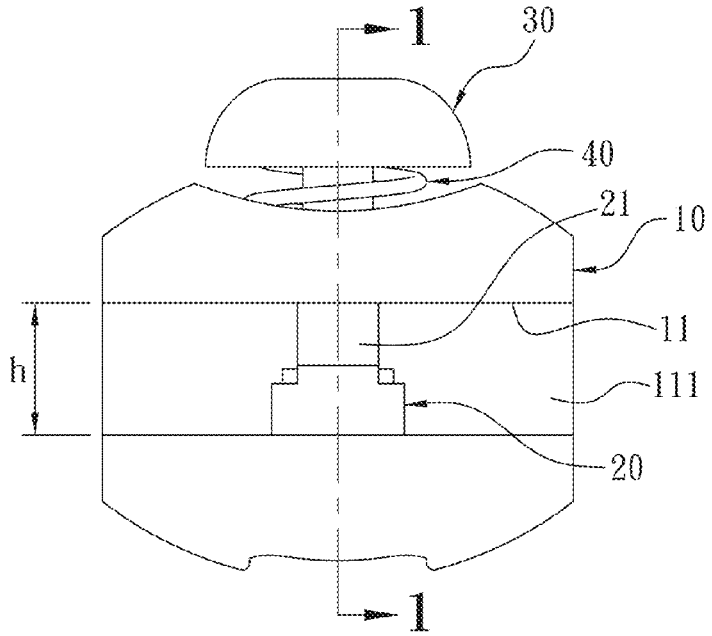
FIG. 3 is a front side view showing the assembly of the weight assembly for the faucet according to the preferred embodiment of the present invention.
Figure 4:
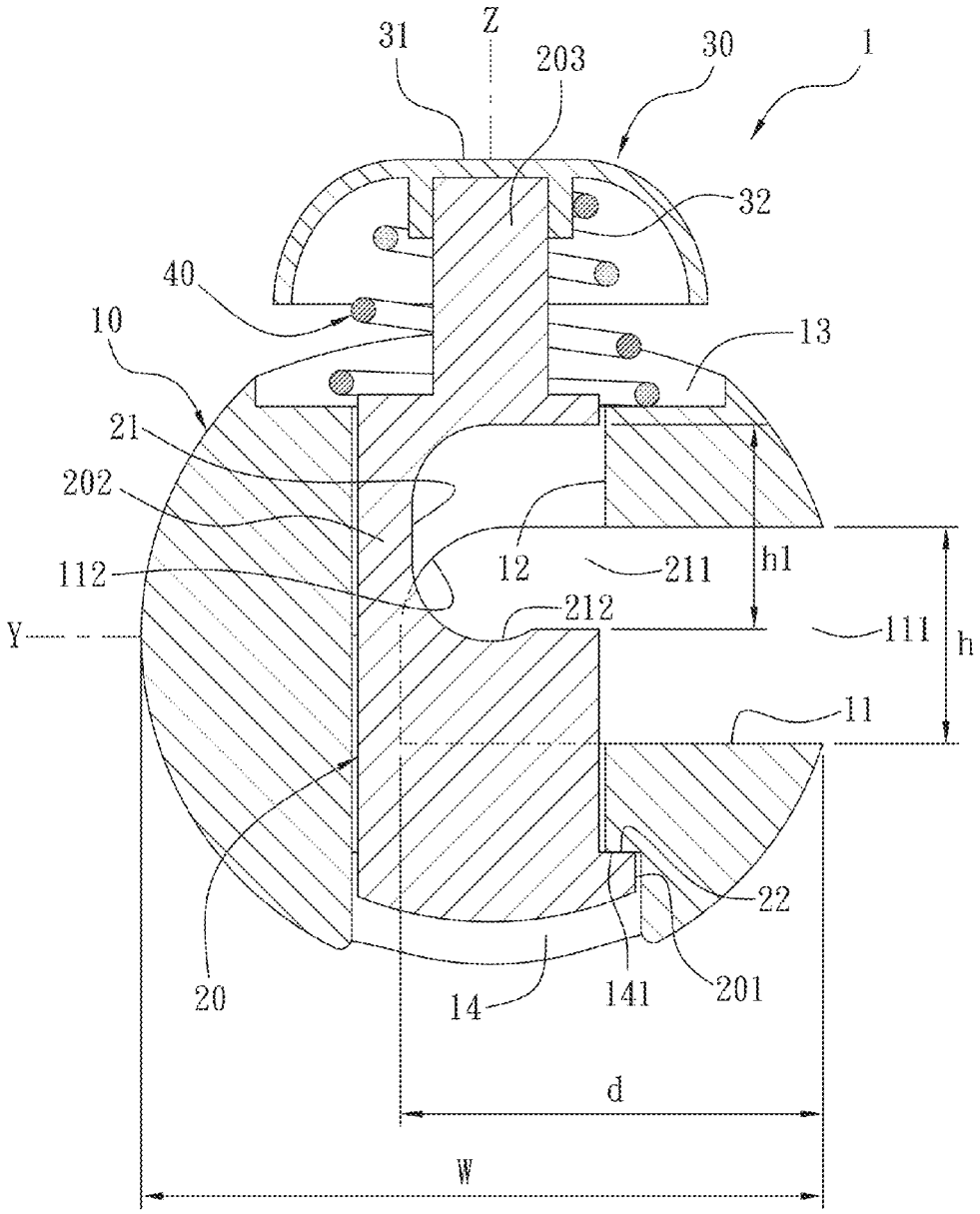
FIG. 4 is a cross sectional view taken along the lines 1-1 of FIG. 3.
Figure 8:
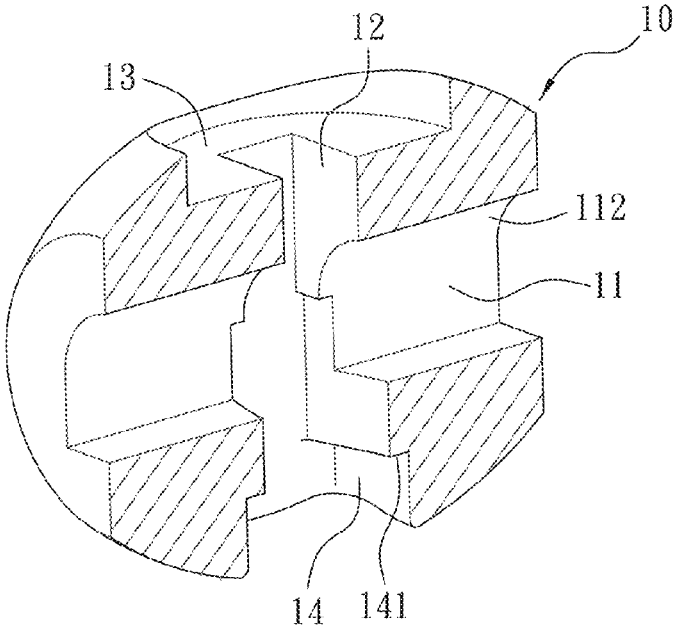
FIG. 8 is a cross-sectional perspective view showing a counterweight of the assembly of the weight assembly for the faucet according to the preferred embodiment of the present invention.
Figure 9:
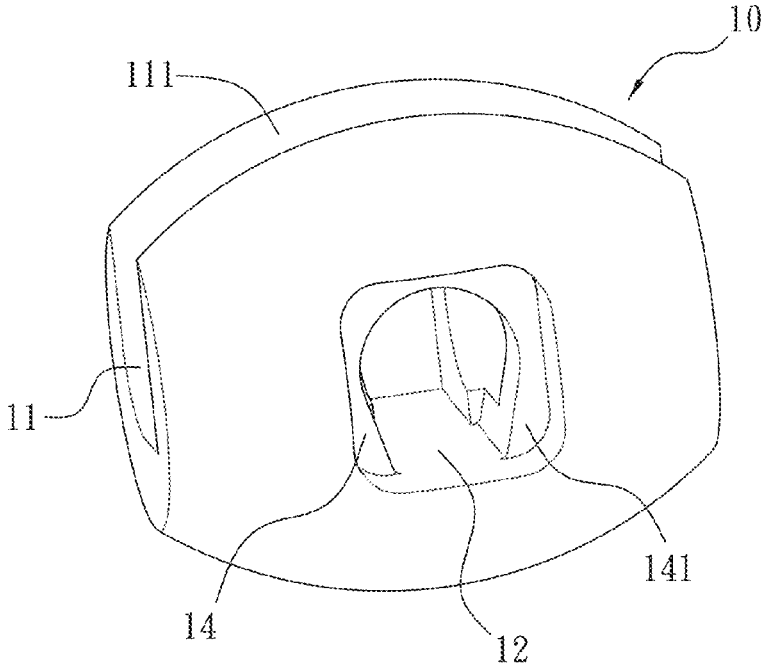
FIG. 9 is a perspective view showing the assembly of the counterweight of the weight assembly for the faucet according to the preferred embodiment of the present invention.

The counterweight 10, as shown in FIGS. 8 and 9, includes an oval profile, a channel 11 (as illustrated in FIG. 2) defined therein in an X-axis direction, wherein a depth d of the channel 11 in a Y-axis direction is more than ½ of a width w of the counterweight 10 in the Y-axis direction as shown in FIG. 4, and the channel 11 has a longitudinal height h defined in a Z-axis direction.

Figure 11:
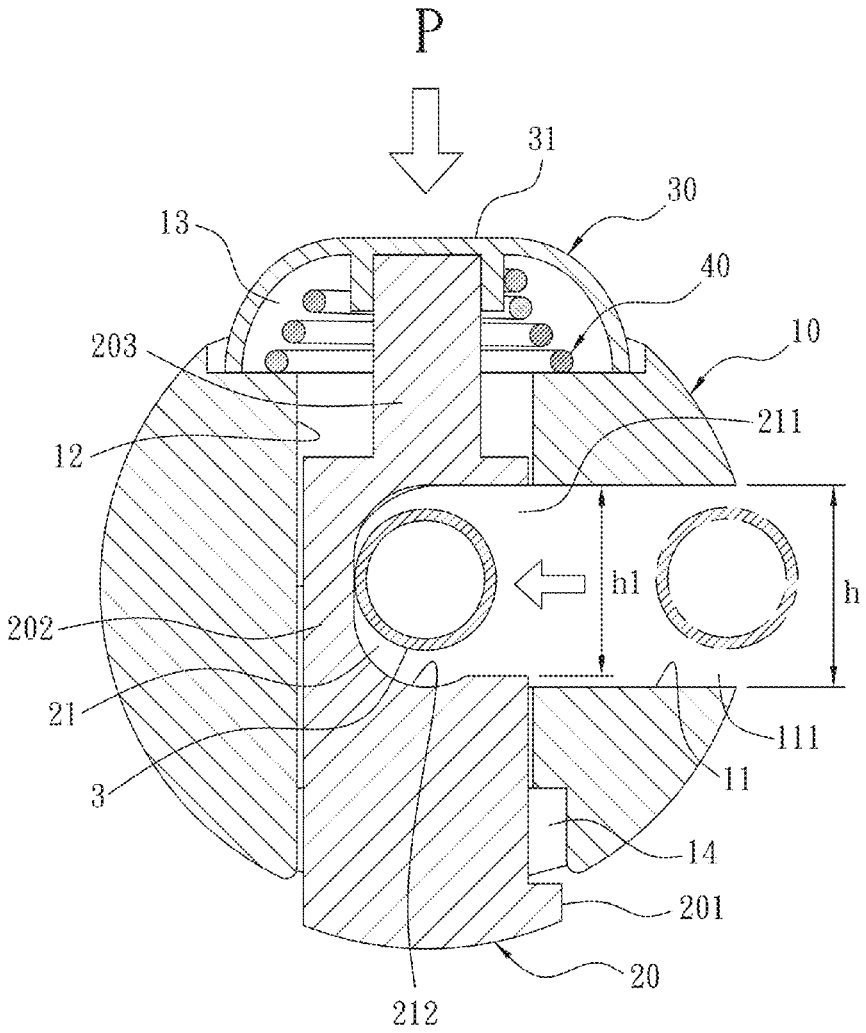
FIG. 11 is a cross-sectional view showing the operation of the weight assembly for the faucet according to the preferred embodiment of the present invention.

The channel 11 also has an elongated first opening 111 defined therein, and the longitudinal height h is larger than a diameter of the hose 3, such that the hose 3 is placed into the channel 11 as shown in FIG. 11, and the depth d of the channel 11 is larger than the diameter of the hose 3 as illustrated in FIG. 4, such that the hose 3 is accommodated in the channel 11 completely. In this embodiment, the depth d is 2.5 times of the diameter of the hose 3, but it is not limited by this value, for example, the depth d is at least one 1.5 times of the diameter of the hose 3.

Figure 12:
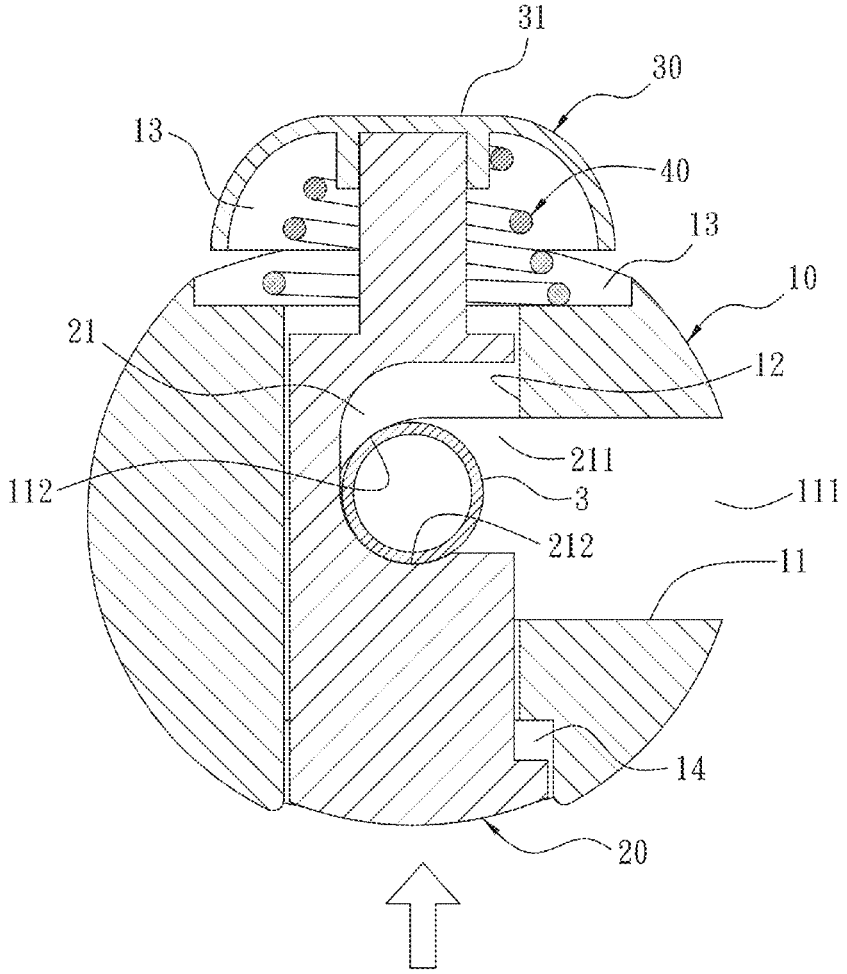
FIG. 12 is another cross-sectional view showing the operation of the weight assembly for the faucet according to the preferred embodiment of the present invention.
Figure 13:
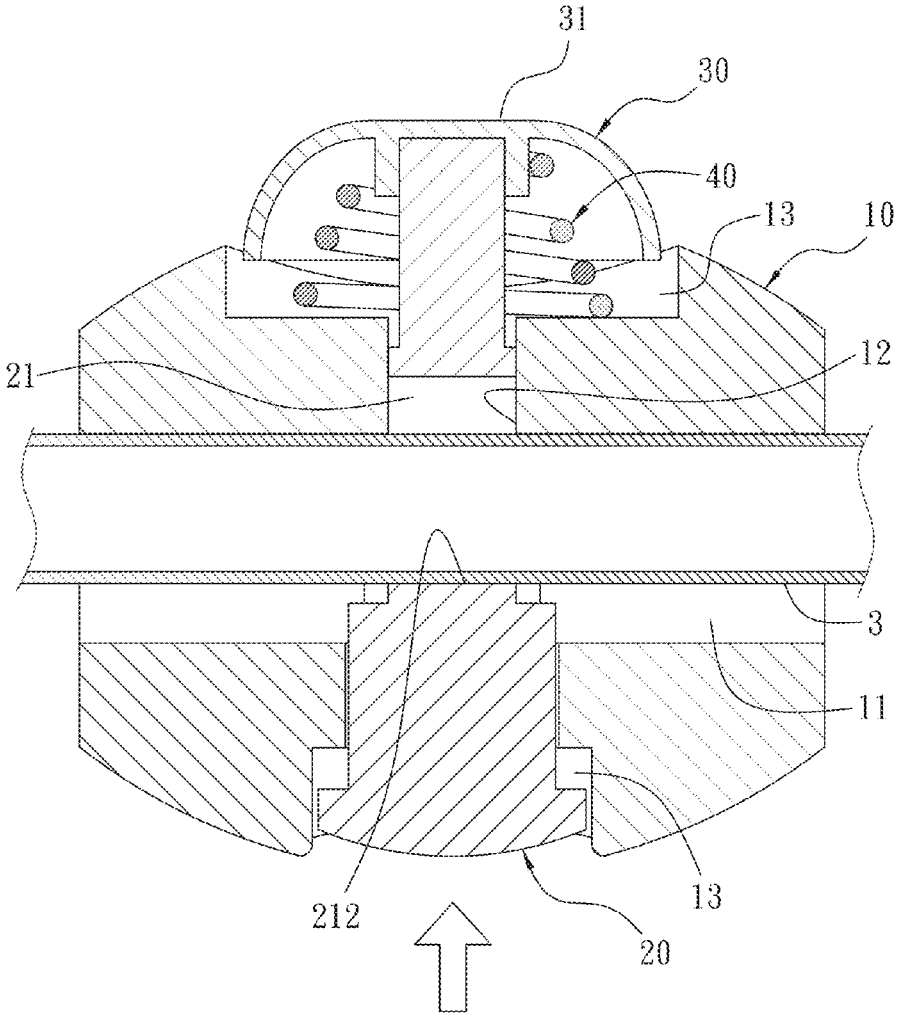
FIG. 13 is also another cross-sectional view showing the operation of the weight assembly for the faucet according to the preferred embodiment of the present invention.

The channel 11 further has an arcuate fence 112 formed on a top end thereof in Y-axis direction, as shown in FIGS. 4, 8 and 12, to contact with the hose 3.

The counterweight 10 also includes a non-circular orifice 12 formed on a central position thereof and along the Z-axis direction, wherein a middle section of the non-circular orifice 12 passes through and communicates with a middle section of the channel 11, and a diameter of the non-circular orifice 12 is more than that of an innermost portion of the channel 11 in the Y-axis direction.

The counterweight 10 further includes a first accommodating cavity 13 defined on a top end thereof in the Z-axis direction and a second accommodating cavity 14 arranged on a bottom end thereof in the Z-axis direction, wherein the non-circular orifice 12 passes through two central portions of the first accommodating cavity 13 and the second accommodating cavity 14.

The counterweight 10 is made of metal material or other materials, such as a metal body covered by a rubber layer.

Figure 10:
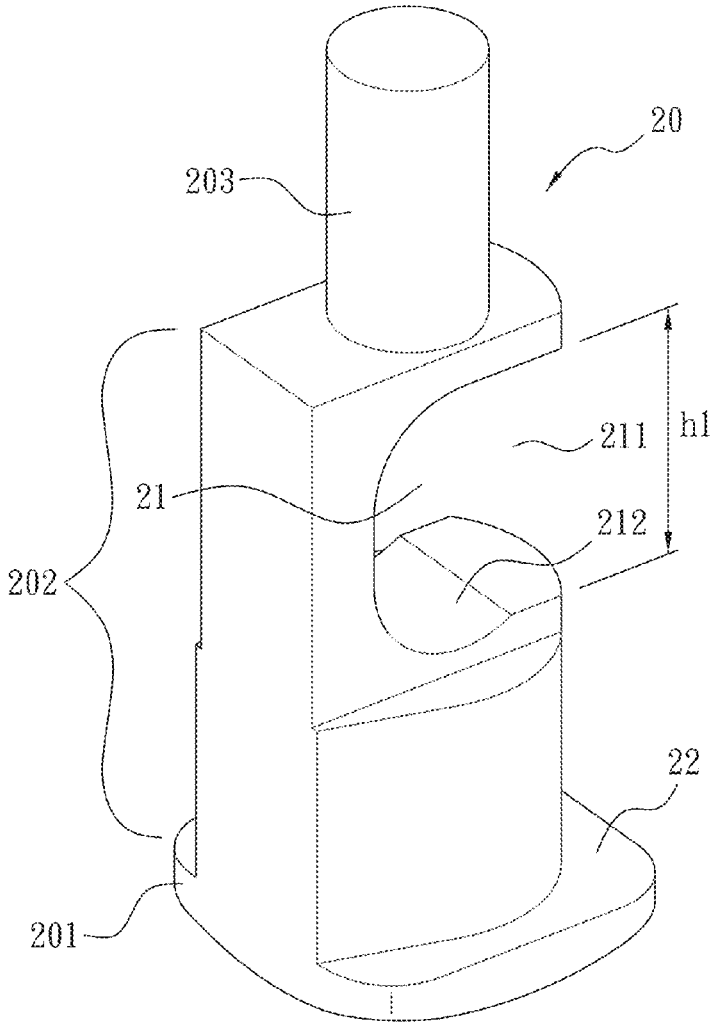
FIG. 10 is a perspective view showing the assembly of a retainer of the weight assembly for the faucet according to the preferred embodiment of the present invention.

As shown in FIG. 10, the retainer 20 is inserted into the second accommodating cavity 14, the non-circular orifice 12 and the first accommodating cavity 13 in turn. The retainer 20 includes a notch 21 arranged on a middle section thereof to define a second opening 211 facing to the first opening 111. The notch 21 has an arc-shaped contacting fringe 212 formed on a bottom end thereof and corresponding to a peripheral wall of the hose 3; a longitudinal height h1 of the second opening 211 along the Z-axis direction is larger than the diameter of the hose 3, such that the hose 3 is inserted into the notch 21 as illustrated in FIGS. 4, 10 and 11. In this embodiment, the longitudinal height h1 is approximately equal to the longitudinal height h1 of the channel 11.

The retainer 20 also includes a base 201, a clamping extension 202 extending upwardly from the base 201, and a column 203 extending upwardly from the clamping extension 202. The base 201 is accommodated in the second accommodating cavity 14 of the counterweight 10 and has a stopping cliff 22 defined thereon to abut against a bottom face 141 of the second accommodating cavity 141, as shown in FIG. 4, such that the retainer 20 is limited by the counterweight 10. The clamping extension 202 is accommodated in the non-circular orifice 12 and has the second opening 211 defined thereon. The column 203 is inserted into the first accommodating cavity 13 to connect with the pressing member.

Figure 5:
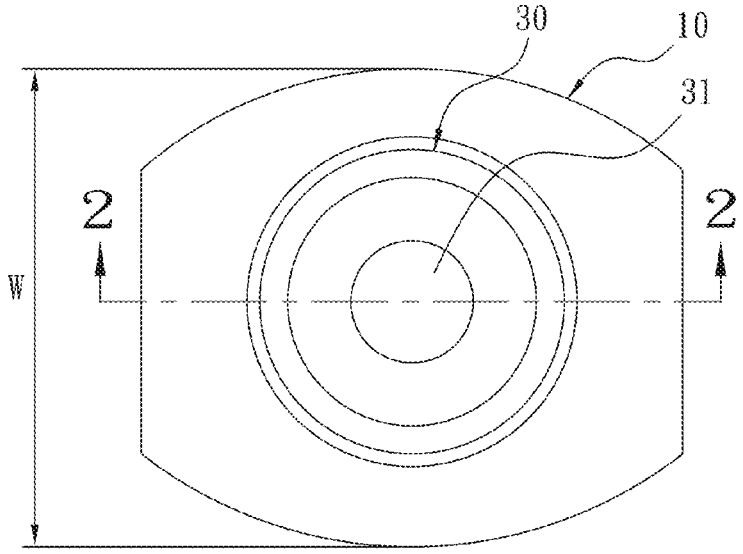
FIG. 5 is a top side view showing the assembly of the weight assembly for the faucet according to the preferred embodiment of the present invention.
Figure 6:
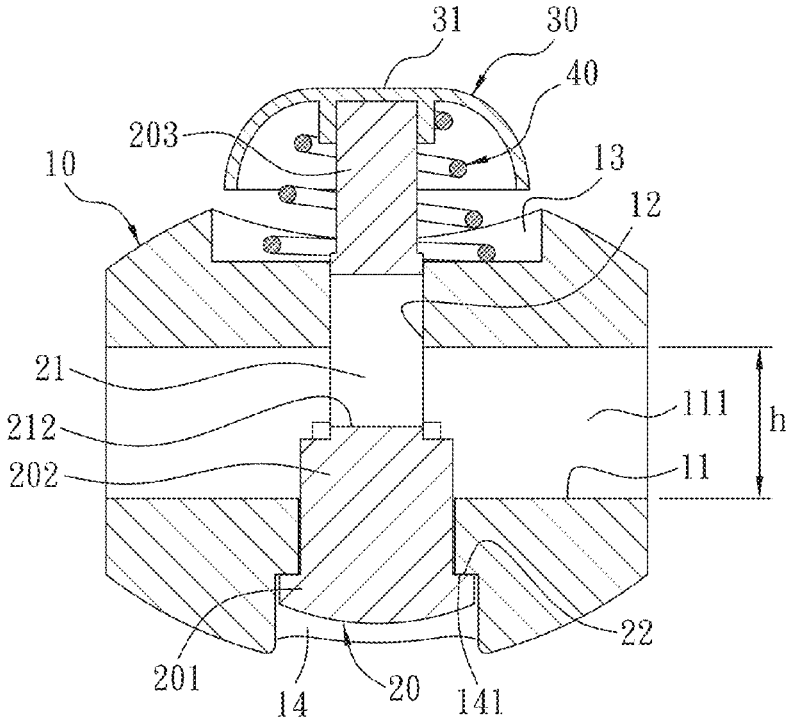
FIG. 6 is a cross sectional view taken along the lines 2-2 of FIG. 5.
Figure 7:
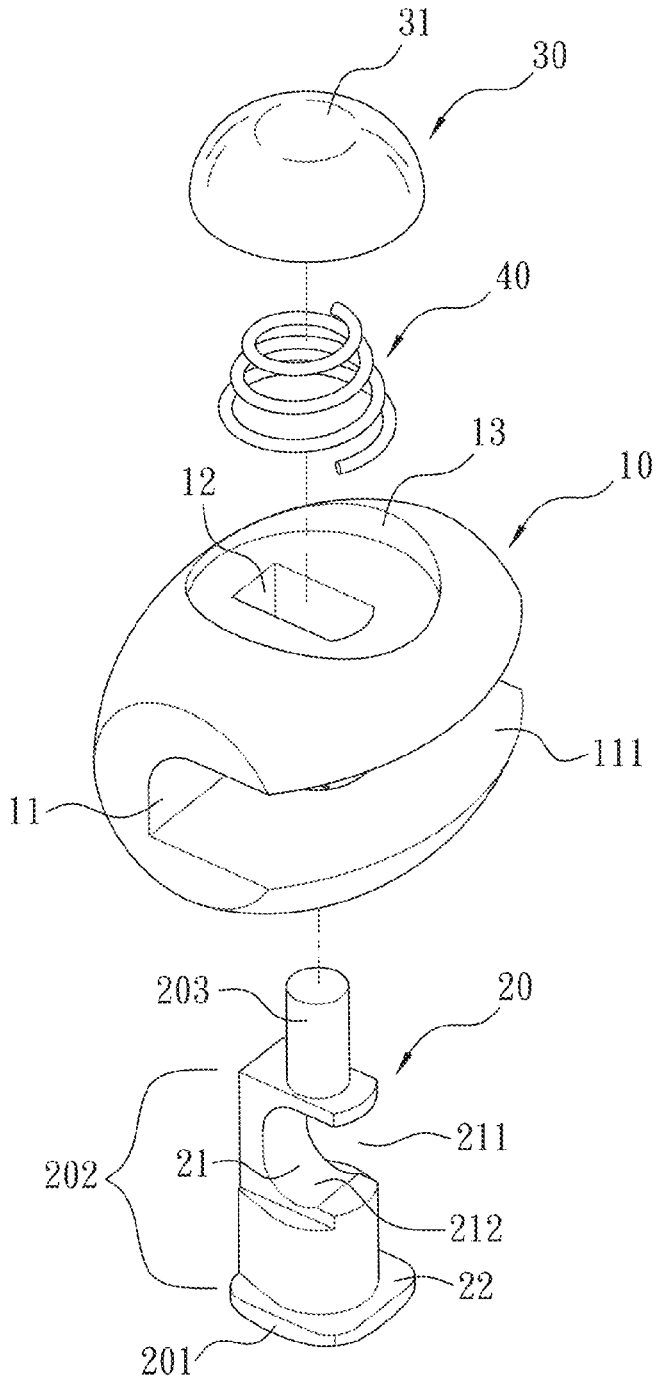
FIG. 7 is a perspective view showing the exploded components of the weight assembly for the faucet according to the preferred embodiment of the present invention.

With reference to FIGS. 4 and 5, the pressing member 30 is mounted on a top end of the column 203 of the retainer 20 and has a press portion 31 arranged on an outer wall thereof so that a user presses the pressing member 30.

The resilient element 40 is defined between the first accommodating cavity 13 of the counterweight 10 and the pressing member 30 to push the pressing member 30, and then the pressing member 30 drives the retainer 20 to move upwardly along the Z-axis direction, such that the hose 3 in the notch 21 of the retainer 20 is retained between the contacting fringe 212 and the arcuate fence 112 of the channel 11.

The resilient element 40 is a compression spring and is fitted on the column 203 of the retainer 20.

The second accommodating cavity 14 is non-circular; the base 201 of the retainer 20 is non-circular to correspond to the second accommodating cavity 14, such that the retainer 20 rotates in the counterweight 10.

The clamping extension 202 is non-circular to correspond to the non-circular orifice 12, such that the retainer 20 rotates in the counterweight 10.

The pressing member 30 also includes a positioning post 32 extending outwardly from an inner wall thereof, as shown in FIG. 4, such that a top segment of the resilient element 40 fits with the positioning post 32. Furthermore, the positioning post 32 is fitted with the top end of the column 203 of the retainer 20. When the retainer 20 and the pressing member 30 are made of metal material, the positioning post 32 is welded with the column 203 of the retainer 20. When the retainer 20 and the pressing member 30 are made of non-metallic material, the positioning post 32 is adhered with the column 203 of the retainer 20 by ways of adhesive. Preferably, the positioning post 32 can be also screwed with the column 203 of the retainer 20.

In operation, the press portion 31 of the pressing member 30 is pressed downwardly so that a longitudinal pressing force P produces on the pressing member 30 along the Z-axis direction to resist against an elasticity of the resilient element 40, and the resilient element 40 is pressed to drive the retainer 20 to move downwardly as illustrated in FIG. 11, such that the second opening 211 of the retainer 20 aligns with the first opening 111 of the counterweight 10, and the hose 3 is inserted into the notch 21 from the first opening 111 through the channel 11 and the second opening 211, thereafter the pressing member 30 is released so that the resilient element 40 pushes the pressing member 30 to move upwardly, and the pressing member 30 and the retainer 20 move upwardly along the Z-axis direction as shown in FIG. 12, hence the hose 3 is retained between the arcuate fence 112 of the channel 11 and the contacting fringe 212 of the notch 21, thus fixing the counterweight 1 and the hose 3 together.

It is to be noted that the pressing member 30 is formed in an arcuate cover shape so that when the pressing member 30 is pressed downwardly, the hose 3 allows inserting through the second opening 211. In other words, a bottom end of the pressing member 30 contacts with a bottom surface of the first accommodating cavity 13, as shown in FIG. 11, and the second opening 211 aligns with the first opening 111, such that the hose 3 is inserted into the notch 21 easily, and the retainer 20 is controlled accurately.

Referring to FIG. 10, after the counterweight 1 is fixed in the hose 3, the hose 2 is retained between the arcuate fence 112 of the channel 11 and the contacting fringe 212, thus fixing the hose 3 and avoiding deformation of the hose 3.

Thereby, the weight assembly 1 of the present invention has following advantages:

1. The hose 3 is fixed easily by pressing and releasing the pressing member 30.

2. The hose 3 is retained at a stable clamping force by using the resilient element 40 to avoid deformation. In other words, the elasticity of the resilient element 40 is controlled easily so that the hose 3 is retained at the stable clamping force.

3. The counterweight 1 is packaged firstly and then is unpacked to connect with the hose 3 quickly.

4. The counterweight 1 is removed and replaced easily by pressing and releasing the pressing member 30.

5. The pressing member 30 is pressed completely so that the hose 3 is inserted into the notch 21 of the retainer 20 exactly and quickly.

6. The hose 3 is retained between the arcuate fence 112 of the channel 11 and the contacting fringe 212 and does not deform.

While the preferred embodiments of the invention have been set forth for the purpose of disclosure, modifications of the disclosed embodiments of the invention as well as other embodiments thereof may occur to those skilled in the art. The scope of the claims should not be limited by the preferred embodiments set forth in the examples, but should be given the broadest interpretation consistent with the description as a whole.

What is claimed is:

1. A weight assembly for a faucet comprising:

a counterweight including a channel defined therein in an X-axis direction, the channel having an elongated first opening defined therein and a longitudinal height defined in a Z-axis direction, and the longitudinal height being larger than a diameter of a hose, such that the hose is placed into the channel, a depth of the channel in a Y-axis direction being larger than the diameter of the hose, and the hose being accommodated in the channel completely; the counterweight also including an orifice formed on a central position thereof and along the Z-axis direction, the orifice passing through and communicating with a middle section of the channel; the counterweight further including a first accommodating cavity defined on a top end thereof in the Z-axis direction and a second accommodating cavity arranged on a bottom end thereof in the Z-axis direction, and the orifice passing through the first accommodating cavity and the second accommodating cavity;

a retainer inserted into the second accommodating cavity, the orifice, and the first accommodating cavity and including a notch arranged on a middle section thereof to define a second opening facing the first opening; the notch having an arc-shaped contacting fringe formed on a bottom end thereof and corresponding to a peripheral wall of the hose; a longitudinal height of the second opening along the Z-axis direction being larger than the diameter of the hose;

a pressing member mounted on a top end of the retainer;

a resilient element defined between the first accommodating cavity of the counterweight and the pressing member to push the pressing member, and then the pressing member driving the retainer to move upwardly along the Z-axis direction, such that the hose in the notch of the retainer is retained between the contacting fringe and the channel.

2. The weight assembly for the faucet as claimed in claim 1, characterized in that the depth of the channel in the Y-axis direction is more than ½ of a width of the counterweight in the Y-axis direction, and the depth is at least one 1.5 times of the diameter of the hose.

3. The weight assembly for the faucet as claimed in claim 2, characterized in that the depth is 2.5 times of the diameter of the hose.

4. The weight assembly for the faucet as claimed in claim 1, characterized in that the channel further has an arcuate fence formed on a top end thereof in Y-axis direction.

5. The weight assembly for the faucet as claimed in claim 1, characterized in that the retainer also includes a base, a clamping extension extending upwardly from the base, and a column extending upwardly from the clamping extension; the base is accommodated in the second accommodating cavity of the counterweight and has a stopping cliff defined thereon to abut against a bottom face of the second accommodating cavity, such that the retainer is limited by the counterweight; the clamping extension is accommodated in the orifice and has the second opening defined thereon; the column is inserted into the first accommodating cavity to connect with the pressing member.

6. The weight assembly for the faucet as claimed in claim 5, characterized in that the second accommodating cavity is non-circular; the base of the retainer is non-circular to correspond to the second accommodating cavity, such that the retainer rotates in the counterweight.

7. The weight assembly for the faucet as claimed in claim 5, characterized in that the orifice is non-circular; and the clamping extension is non-circular to correspond to the orifice, such that the retainer rotates in the counterweight.

8. The weight assembly for the faucet as claimed in claim 5, characterized in that the resilient element is a compression spring and is fitted on the column of the retainer.

9. The weight assembly for the faucet as claimed in claim 8, characterized in that the pressing member also includes a positioning post extending outwardly from an inner wall thereof, such that a top segment of the resilient element fits with the positioning post.

10. The weight assembly for the faucet as claimed in claim 5, characterized in that the resilient element is a compression spring and is fitted on the column of the retainer; the pressing member has a press portion arranged on an outer wall thereof and a positioning post, such that a top segment of the resilient element fits with the positioning post, and the positioning post is fitted with a top end of the column of the retainer.

* * * * *